US006150577A

United States Patent [19]

Miller et al.

[11] Patent Number: 6,150,577

[45] Date of Patent: Nov. 21, 2000

[54] METHOD FOR CONVERSION OF WASTE PLASTICS TO LUBE OIL

[75] Inventors: Stephen J. Miller, San Francisco, Calif.; Gerald P. Huffman; Naresh Shah, both of Lexington, Ky.

[73] Assignee: Chevron U.S.A., Inc., Camino Ramon, Calif.

[21] Appl. No.: 09/224,554

[22] Filed: Dec. 30, 1998

[51] Int. Cl.[7] ..... C07C 5/13; C10G 55/04; C10G 35/04

[52] U.S. Cl. ..... 585/241; 585/240; 585/734; 585/739; 208/69; 208/97; 208/134

[58] Field of Search ..... 208/69, 97, 134; 585/240, 241, 734, 739

[56] References Cited

U.S. PATENT DOCUMENTS

| | | | |
|---|---|---|---|
| 3,852,207 | 12/1974 | Stangeland et al. | 208/58 |
| 3,904,513 | 9/1975 | Fischer et al. | 208/264 |
| 4,016,218 | 4/1977 | Haag et al. | 260/671 |
| 4,016,245 | 4/1977 | Plank et al. | 423/328 |
| 4,157,294 | 6/1979 | Iwao et al. | 208/264 |
| 4,481,177 | 11/1984 | Valyocsik | 423/329 |
| 4,483,835 | 11/1984 | Zones | 423/277 |
| 4,533,649 | 8/1985 | Ball et al. | 502/71 |
| 4,556,477 | 12/1985 | Dwyer | 208/111 |
| 4,673,487 | 6/1987 | Miller | 208/58 |
| 4,836,910 | 6/1989 | van de Griend et al. | 208/120 |
| 4,921,594 | 5/1990 | Miller | 208/58 |
| 5,135,638 | 8/1992 | Miller | 208/27 |
| 5,158,671 | 10/1992 | Cody et al. | 208/264 |
| 5,208,005 | 5/1993 | Miller | 423/702 |
| 5,252,527 | 10/1993 | Zones | 502/64 |
| 5,354,930 | 10/1994 | Atkins | 585/241 |
| 5,821,395 | 10/1998 | Price et al. | 585/241 |

FOREIGN PATENT DOCUMENTS

| | | |
|---|---|---|
| 0 065 400 B1 | 3/1986 | European Pat. Off. . |
| 0 620 264 A2 | 10/1994 | European Pat. Off. . |

OTHER PUBLICATIONS

U.S. Application Serial No. 09/223,227, Stephen J. Miller et al., "Method for Making a Heavy Wax Composition", filed Dec. 30, 1998.

U.S. Application Serial No. 09/224,555, Stephen J. Miller, "Method for Making a Lubricating Composition", filed Dec. 30, 1998.

*Primary Examiner*—Walter D. Griffin
*Assistant Examiner*—Tam Nguyen
*Attorney, Agent, or Firm*—W Keith Turner

[57] ABSTRACT

The invention includes a process of making a lubricating oil composition including: a process for making a high VI lubricating oil composition including the steps of (1) contacting a waste plastics feed including mainly polyethylene in a pyrolysis zone at pyrolysis conditions, whereby at least a portion of the waste plastics feed is cracked, thereby forming a pyrolysis zone effluent including 1-olefins and n-paraffins; (2) passing the pyrolysis zone effluent, including a heavy fraction and a middle fraction, the pyrolysis effluent middle fraction including 1-olefins, to a separations zone; where the pyrolysis effluent heavy fraction portion is separated from the pyrolysis effluent middle fraction; (3) passing the pyrolysis effluent heavy fraction to a hydrogenation zone; and (4) passing at least a portion of the hydrogenation zone effluent to a catalytic isomerization dewaxing zone, where at least a portion of the hydrogenation zone effluent is contacted with a isomerization dewaxing catalyst at isomerization dewaxing conditions thereby forming a high VI lubricating oil composition.

28 Claims, 3 Drawing Sheets

CONVERSION OF PYROLYZED HDPE TO LUBE OIL

CONVERSION OF PYROLYZED HDPE TO LUBE OIL

METHOD FOR CONVERSION OF WASTE PLASTICS TO LUBE OIL

FIELD OF THE INVENTION

The present invention relates to a process for making a lubricating composition and other useful products from polymers/plastics, especially from waste polymers/plastics, particularly polyethylene.

BACKGROUND OF THE INVENTION

Manufacturers of mechanical and hydraulic equipment regularly increase the viscometric requirements for lubricating compositions used in such equipment. These increases are driven by a desire for reduced maintenance and lubricating composition replacement, a desire for and laws and regulations for reduced environmental emissions, and by the closer tolerances of moving parts, higher operating temperatures, and other changes in new equipment designs.

Manufacturing a lubricating composition that meets more stringent viscometric requirements is typically more expensive than manufacturing a lubricating composition meeting less stringent viscometric requirements. This may be due to both a higher priced feed to such a process and additional or more expensive processing involved in such manufacturing. A high viscosity index ("VI") is a key measure of a superior lubricating composition. "High VI" is defined in detail later in this specification. High VI lubricating compositions have traditionally been manufactured synthetically from polymers. The addition of polymeric VI improvers also has been traditionally employed to improve the VI performance of mineral oils. These are expensive ways, however, to obtain a lubricating composition having a high VI.

It would be advantageous to have a relatively inexpensive process for producing high VI lubricating compositions. Such a process would ideally utilize a readily available inexpensive feedstock. Waste plastics/polymers have been used in known processes for the manufacture of some synthetic hydrocarbons, typically fuels or other polymers.

According to the latest report from the Office of Solid Waste, USEPA, about 62% of plastic packaging in the U.S. is made of polyethylene, the preferred feed for a plastics to lubes process. Equally important, plastics waste (after recycling) is the fastest growing waste product with about 18 million tons/yr in 1995 compared to only 4 million tons/yr in 1970. This presents a unique opportunity, not only to acquire a useful source of high quality lube, but also address a growing environmental problem at the same time.

Dewaxing is required when highly paraffinic oils are to be used in products which need to remain mobile at low temperatures, e.g., lubricating oils, heating oils and jet fuels. The higher molecular weight straight chain normal and slightly branched paraffins which are present in oils of this kind are waxes which cause high pour points and high cloud points in the oils. If adequately low pour points are to be obtained, these waxes must be wholly or partly removed.

Methods are known for upgrading to lubricating compositions various waxy feeds by dewaxing. Various solvent removal techniques are known, such as propane dewaxing and MEK dewaxing but these techniques are costly and time consuming. Solvent dewaxing removes waxes by dissolving them in the solvent, then separating the solvent containing the dissolved wax from the lube oil range material. Where a major portion of the feed is wax, solvent dewaxing leaves only the minor portion of lube oil remaining.

Catalytic dewaxing, on the other hand, does not separate out waxes, but rather converts them to light products boiling below the lube oil range. The conversion is achieved by selectively cracking the longer chain waxy molecules to produce lower molecular weight products, some of which may be removed by distillation. Isomerization catalytic dewaxing is another form of catalytic dewaxing. It is superior to other dewaxing methods. Isomerization catalytic dewaxing achieves a lower pour point neither by removing the wax nor by cracking the wax. Rather, it achieves a lower pour point by isomerizing the wax. Isomerization dewaxing is taught in U.S. Pat. No. 5,135,638 (the '638 patent). However, the '638 patent does not teach the use of isomerization dewaxing for a feed derived from a waste plastics feed.

EP patent application 0620264A2 discloses a process for making a lube oil from waste plastics. The process utilizes a cracking process in a fluidized bed of inert solids and fluidized with, e.g., nitrogen. The product of the cracking is hydrotreated over an alumina catalyst or other refractory metal oxide support containing a metal component, and then optionally catalytically isomerized. The overall yield, however, is lower than desired. The isomerization catalysts taught partially cause this result. There is no teaching of using better isomerization catalysts. Also, EP 0620264A2 does not teach a process of producing a high yield of heavy lube oils.

It would be advantageous to have a process using readily available waste plastics to produce a high yield of high VI lubricating oil compositions, especially heavy high VI lubricating oil compositions. The process of the present invention meets this need.

SUMMARY OF THE INVENTION

The invention includes a process of making a lubricating oil composition including: a process for making a high VI lubricating oil composition including the steps of (1) contacting a waste plastics feed containing primarily polyethylene in a pyrolysis zone at pyrolysis conditions, whereby at least a portion of the waste plastics feed is cracked, thereby forming a pyrolysis zone effluent including 1-olefins and n-paraffins; (2) passing the pyrolysis zone effluent, including a heavy fraction and a pyrolysis effluent middle fraction (each defined in the detailed description), including normal alpha olefins, to a separations zone; where the pyrolysis effluent heavy fraction heavy fraction is separated from the pyrolysis effluent middle fraction; (3) passing the pyrolysis effluent heavy fraction to a hydrotreating zone; and (4) passing at least a portion of the hydrotreating zone effluent to a catalytic isomerization dewaxing zone, where at least a portion of the hydrotreating zone effluent is contacted with a isomerization dewaxing catalyst at isomerization dewaxing conditions, where at least a portion of the hydrotreating zone effluent is converted to a high VI lubricating oil composition.

DETAILED DESCRIPTION OF PREFERRED EMBODIMENTS

A. Process Overview

Figure 1:
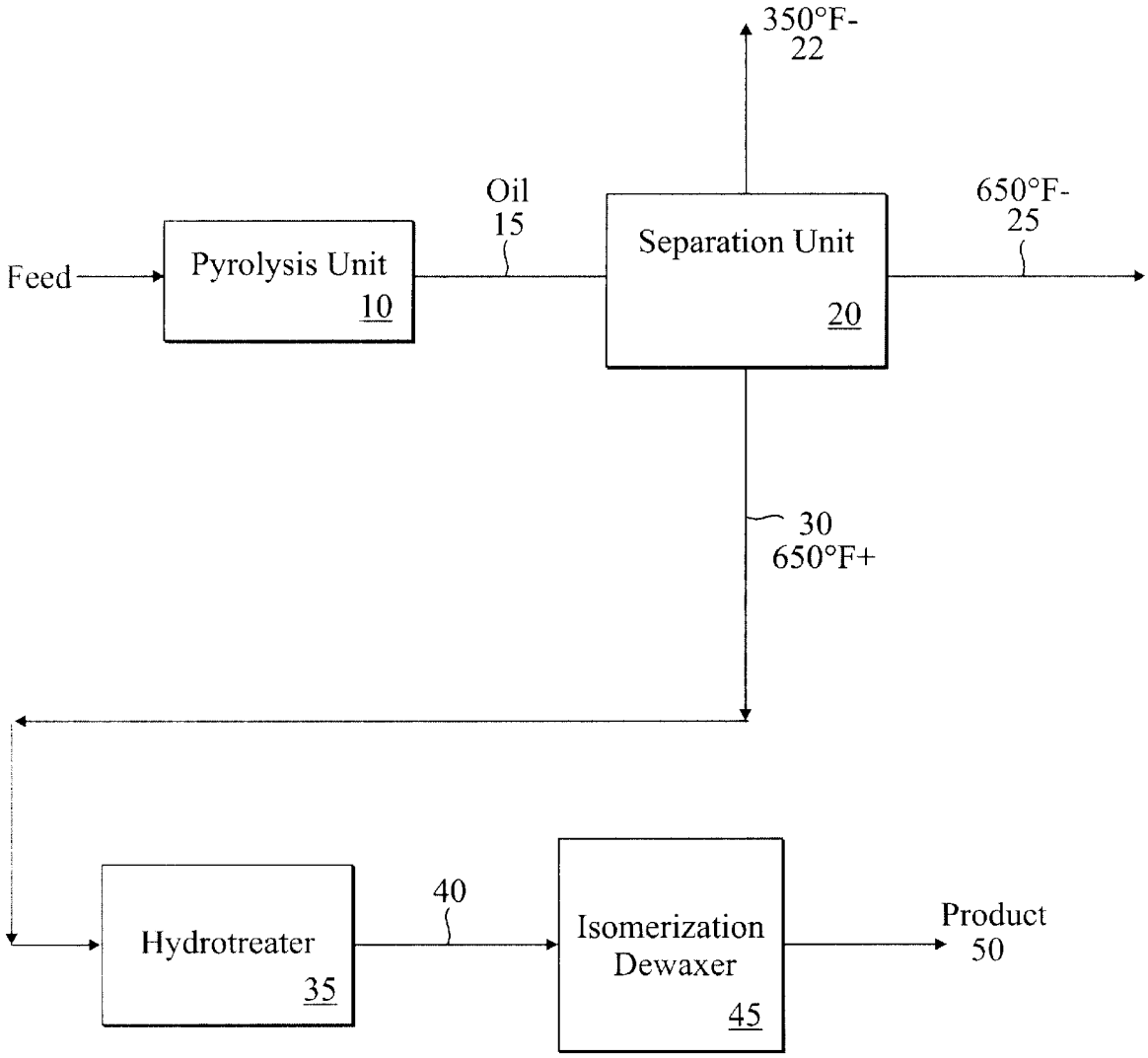
FIG. 1 is a schematic flow drawing of one embodiment of the process of the invention.

FIG. 1 is a schematic flow drawing of one embodiment of the process of the invention. Waste PE feed stream 5 is fed to pyrolysis zone 10. The pyrolysis zone effluent 15 is passed to separations zone 20. The lube boiling range material in the pyrolysis zone effluent has a BP from about 650° F. to about 1200° F. In separations zone 20 pyrolysis zone effluent 15 is separated into 2 or more streams as shown by 350° F.–boiling point ("BP") stream 22, i.e., light fraction, 350–650° F. BP stream 25, i.e., middle fraction, and 650° F.+ BP stream 30, i.e., heavy fraction. Heavy fraction stream 30 is passed to hydrotreating zone 35, thereby producing hydrotreating zone effluent stream 40. Stream 40 is passed to catalytic isomerization dewaxing zone 45. The isomerization dewaxing zone effluent 50 is a high VI lubricating oil composition. An additional separation zone (not shown) optionally follows isomerization zone 50 for fractionating the lube into fractions of various viscometric properties.

B. Pyrolysis

The first step in the process for making a high VI lubricating oil composition according to the invention is contacting a waste plastics feed containing polyethylene in a pyrolysis zone at pyrolysis conditions, where at least a portion of the waste plastics feed is cracked, thus forming a pyrolysis zone effluent comprising 1-olefins and n-paraffins. The percentage of 1-olefins in the pyrolysis zone effluent is optionally from about 25 to 75 wt. %, preferably from about 40–60 wt. %. Pyrolysis conditions include a temperature of from about 500–700° C., preferably from about 600–700° C.

Conventional pyrolysis technology teaches operating conditions of above-atmospheric pressures. See, e.g., U.S. Pat. No. 4,642,401. It has been discovered that by adjusting the pressure downward, the yield of a desired product can be controlled. For a Neutral stock range lubricating oil composition, the pyrolysis zone pressure is about atmospheric, preferably from about 0.75 atm to about 1 atm. For a bright stock range lubricating composition, the pyrolysis zone pressure is preferably sub-atmospheric, preferably not greater than about 0.75 atmospheres or 0.5 atmospheres. It has been discovered that sub-atmospheric pressures in the pyrolysis zone results in a greater yield of bright stock range lubricating composition, since the thermally cracked waste plastic goes overhead and out of the pyrolysis zone before secondary cracking can occur.

The pyrolysis zone pressure is optionally controlled by vacuum or by addition of an inert gas (i.e., acts inert in the pyrolysis zone), e.g., selected from the group comprising nitrogen, hydrogen, steam, methane or recycled light ends from the pyrolysis zone. The inert gas reduces the partial pressure of the waste plastic gaseous product. It is this partial pressure which is of interest in controlling the weight of the pyrolysis zone product.

The pyrolysis zone effluent (liquid portion) is very waxy and has a too high pour point. It comprises n-paraffins and some olefins. Further processing according to the invention is needed to convert it to a high VI lubricating oil composition.

The feed may contain some contaminants normally associated with waste plastics, e.g., paper labels and metal caps. Typically, from about 80 wt. % to about 100 wt. % of the waste plastics feed consists essentially of polyethylene, preferably about 95 wt. % to about 100 wt. %. Typically, the feed is prepared by grinding to a suitable size for transport to the pyrolysis unit using any conventional means for feeding solids to a vessel. Optionally, the ground waste plastics feed is also heated and initially dissolved in a solvent. The heated material is then passed by an auger, or other conventional means, to the pyrolysis unit. After the initial feed, a portion of the heated liquefied feed from the pyrolysis zone is optionally removed and recycled to the feed to provide a heat source for dissolving the feed.

The feed may contain chlorine, preferably less than about 20 ppm. Preferably, a substantial portion of any chlorine in the feed is removed by the addition to the feed of a chlorine scavenger compound, e.g., sodium carbonate. It reacts in the pyrolysis zone with the chlorine to form sodium chloride which becomes part of the residue at the bottom of the pyrolysis zone. Preferably, the chlorine content is removed to less that about 5 ppm.

C. Separations Step

The pyrolysis zone effluent typically contains a broad boiling point range of materials. The pyrolysis zone effluent is passed to a conventional separations zone, e.g., distillation column; where it is separated in typically at least three fractions, a light, middle, and heavy fraction. The light fraction contains, e.g., 350° F.–BP, gasoline range material, and gases. The middle fraction is typically a middle distillate range material, e.g., diesel fuels range, e.g., 350–650° F. BP. The heavy fraction is lube oil range material, e.g., 650° F.+ BP. All fractions contain n-paraffins and 1-olefins.

D. Hydrotreating

Prior to catalytic isomerization dewaxing, the pyrolysis effluent is preferably hydrotreated to remove compounds, e.g., N, S or O containing compounds, that could deactivate the isomerization dewaxing catalyst or produce an unstable lubricating oil composition, e.g., color instability. Hydrotreating is typically conducted by contacting the pyrolysis effluent heavy fraction with a hydrotreating catalyst at hydrotreating conditions. A conventional catalytic hydrotreating process may be used.

The hydrotreating is done under conditions to remove substantially all heteroatoms, while minimizing cracking. Typically, hydrotreating conditions include temperatures ranging from about 190° C. to about 340° C., pressures of from about 400 psig to about 3000 psig, space velocities (LHSV) of from about 0.1 to about 20, and hydrogen recycle rates of from about 400 to about 15000 SCF/bbl.

Suitable hydrogenation catalysts include conventional, metallic hydrogenation catalysts, particularly the Group VIII metals such as Co, Mo, Ni, and W. The metals are typically associated with carriers such as bauxite, alumina, silica gel, silica-alumina composites, and crystalline aluminosilicate zeolites and other molecular sieves. If desired, non-noble Group VIII metals can be used with molybdates or tungstates. Metal oxides, e.g., nickel/cobalt promoters, or sulfides can be used. Suitable catalysts are disclosed in U.S. Pat. Nos. 3,852,207; 4,157,294; 4,921,594; 3,904,513 and 4,673,487, the disclosures of which are incorporated herein by reference. The S and N levels of the hydrotreated pyrolysis effluent heavy fraction portion are preferably not greater that about 5 ppm S and 1 ppm N.

E. Catalytic Isomerization Dewaxing

The pyrolysis zone effluent (liquid portion) is very waxy and has a too high pour point. To reduce the pour point while maintaining high yield, the hydrotreating zone effluent is passed to a catalytic isomerization dewaxing zone. Optionally, the hydrotreating zone effluent is first passed to a second separations zone for separation out of the heaviest material, e.g., 1000° F.+ BP. The fraction having a lower BP is the one sent to the isomerization dewaxing zone. The 1000° F.+ BP fraction is the most difficult to isomerize. Thus, optionally, it is not isomerized, but is useful as a high grade heavy wax.

For the portion of the hydrotreating zone effluent isomerized, after isomerization catalytic dewaxing, at least a portion of the feed to the isomerization catalytic dewaxing zone is converted to a high VI lubricating oil composition. Unlike solvent dewaxing which is a separations process, isomerization catalytic dewaxing converts the n-paraffins into iso-paraffins, thereby reducing the pour point to form a high VI lubricating oil composition with a much higher yield. Preferably, a portion of such high VI lubricating oil composition has a BP in the bright stock range (may be referenced as "composition in some of the claims portion of this specification). More preferably, a substantial portion (i.e., >10 wt. %) or major portion (i.e., >50 wt. %) has a BP in the bright stock range. The pour point (as measured by ASTM D97) of the high VI lubricating oil composition is not more than about 20° F., preferably not more than about 15° F. The cloud point (as measured by ASTM D2500) is preferably not more than about 10° F. higher than the pour point. Preferably, either or both of the first and second high VI lubricating oil compositions include a lube fraction having a kinematic viscosity at 100° C. of at least about 8 cSt. This and other fractions can be separated by conventional separation processes. Preferably the 8 cSt fraction is at least about 10 wt. % (a substantial portion), more preferably at least about 50 wt. % (a major portion) of the high VI lubricating composition.

The isomerization catalytic dewaxing zone is operated as taught in U.S. Pat. No. 5,135,638, which disclosure is incorporated herein by reference. In brief, the dewaxing zone is practiced as discussed below. The process includes any solid catalyst capable of isomerization dewaxing. Preferably, the catalyst is an intermediate pore size molecular sieve. The phrase "intermediate pore size", as used herein, means an effective pore aperture in the range of from about 5.3 to about 6.5 Angstroms when the porous inorganic oxide is in the calcined form. Molecular sieves having pore apertures in this range tend to have unique molecular sieving characteristics. Unlike small pore zeolites such as erionite and chabazite, they will allow hydrocarbons having some branching into the molecular sieve void spaces. Unlike larger pore zeolites such as the faujasites and mordenites, they can differentiate between n-alkanes and slightly branched alkanes, and larger branched alkanes having, for example, quaternary carbon atoms.

The effective pore size of the molecular sieves can be measured using standard adsorption techniques and hydrocarbonaceous compounds of known minimum kinetic diameters. See Breck, *Zeolite Molecular Sieves,* 1974 (especially Chapter 8); Anderson et al., *J. Catalysis* 58, 114 (1979); and U.S. Pat. No. 4,440,871, the pertinent portions of which are incorporated herein by reference.

In performing adsorption measurements to determine pore size, standard techniques are used. It is convenient to consider a particular molecule as excluded if it does not reach at least 95% of its equilibrium adsorption value on the molecular sieve in less than about 10 minutes (p/po=0.5; 25° C.). Intermediate pore size molecular sieves will typically admit molecules having kinetic diameters of 5.3 to 6.5 Angstroms with little hindrance. Examples of such compounds (and their kinetic diameters in Angstroms) are: n-hexane (4.3), 3-methylpentane (5.5), benzene (5.85), and toluene (5.8). Compounds having kinetic diameters of about 6 to 6.5 Angstroms can be admitted into the pores, depending on the particular sieve, but do not penetrate as quickly and in some cases are effectively excluded. Compounds having kinetic diameters in the range of 6 to 6.5 Angstroms include: cyclohexane (6.0), 2,3-dimethylbutane (6.1), and m-xylene (6.1). Generally, compounds having kinetic diameters of greater than about 6.5 Angstroms do not penetrate the pore apertures and thus are not absorbed into the interior of the molecular sieve lattice. Examples of such larger compounds include: o-xylene (6.8), 1,3,5-trimethylbenzene (7.5), and tributylamine (8.1).

The preferred effective pore size range is from about 5.5 to about 6.2 Angstroms. While the effective pore size as discussed above is important to the practice of the invention, not all intermediate pore size molecular sieves having such effective pore sizes are advantageously usable in the practice of the present invention. Indeed, it is essential that the intermediate pore size molecular sieve catalysts used in the practice of the present invention have a very specific pore shape and size as measured by X-ray crystallography. First, the intracrystalline channels must be parallel and must not be interconnected. Such channels are conventionally referred to as 1-D diffusion types or more shortly as 1-D pores. The classification of intrazeolite channels such as 1-D, 2-D and 3-D is set forth by R. M. Barrer in *Zeolites, Science and Technology,* edited by F. R. Rodrigues, L. D. Rollman and C. Naccache, NATO ASI Series, 1984, which classification is incorporated in its entirety by reference (see particularly page 75). Known 1-D zeolites include cancrinite hydrate, laumontite, mazzite, mordenite and zeolite L.

None of the above listed 1-D pore zeolites, however, satisfies the second essential criterion for catalysts useful in the practice of the present invention. This second essential criterion is that the pores must be generally oval in shape, by which is meant the pores must exhibit two unequal axes referred to herein as a minor axis and a major axis. The term oval as used herein is not meant to require a specific oval or elliptical shape but rather to refer to the pores exhibiting two unequal axes. In particular, the 1-D pores of the catalysts useful in the practice of the present invention must have a minor axis between about 3.9 Angstroms and about 4.8 Angstroms and a major axis between about 5.4 Angstroms and about 7.0 Angstroms as determined by conventional X-ray crystallography measurements.

The catalyst used in the isomerization process of the invention has an acidic component and a platinum and/or palladium hydrogenation component. In accordance with one embodiment of the invention, the acidic component can suitably comprise an intermediate pore size silicoaluminophosphate molecular sieve which is described in U.S. Pat. No. 4,440,871, the pertinent disclosure of which is incorporated herein by reference.

The most preferred intermediate pore size silicoaluminophosphate molecular sieve for use in the process of the invention is SAPO-11, especially SM-3 (as taught in U.S. Pat. No. 5,208,005, which reference is incorporated herein by reference in its entirety). SAPO-11 comprises a molecular framework of corner-sharing $[SiO_2]$tetrahedra, $[AlO_2]$ tetrahedra, and $[PO_2]$tetrahedra, [i.e., $(Si\ x\ Al\ y\ P\ z\ )O_2$ tetrahedral units]. When combined with a platinum or palladium hydrogenation component, the SAPO-11 converts the waxy components to produce a lubricating oil having excellent yield, very low pour point, low viscosity and high viscosity index.

SAPO-11 comprises a silicoaluminophosphate material having a three-dimensional microporous crystal framework structure of $[PO_2]$, $[AlO_2]$ and $[SiO_2]$tetrahedral units whose unit empirical formula on an anhydrous basis is:

$$mR: (Si\ x\ Al\ y\ P\ z)O_2(l)$$

wherein "R" represents at least one organic templating agent present in the intracrystalline pore system; "m" represents the moles of "R" present per mole of (Si x Al y P z)$O_2$ and has a value of from zero to about 0.3; "x", "y" and "z" represent, respectively, the mole fractions of silicon, aluminum and phosphorous. The silicoaluminophosphate has a characteristic X-ray powder diffraction pattern which contains at least the d-spacings (as-synthesized and calcined) set forth below in Table I. When SAPO-11 is in the as-synthesized form, "m" preferably has a value of from 0.02 to 0.3.

TABLE I

| 2θ | d(Å) | Relative Intensity |
|---|---|---|
| 9.4–9.65 | 9.41–9.17 | m |
| 20.3–20.6 | 4.37–4.31 | m |
| 21.0–21.3 | 4.23–4.17 | vs |
| 22.1–22.35 | 4.02–3.99 | m |
| 22.5–22.9 (doublet) | 3.95–3.92 | m |
| 23.15–23.35 | 3.84–3.81 | m–s |

All of the as-synthesized SAPO-11 compositions for which X-ray powder diffraction data have been obtained to date have patterns which are within the generalized pattern of Table II below.

These values were determined by standard techniques. The radiation was the K-alpha doublet of copper and a diffractometer equipped with a scintillation counter and an associated computer was used. The peak heights, I, and the positions as a function of 2 θ, where θ is the Bragg angle, were determined using algorithms on the computer associated with the spectrometer. From these, the relative intensities, 100 $I/I_o$, where I is the intensity of the strongest line or peak, and d (obs.) the interplanar spacing in Angstroms, corresponding to the recorded lines, were determined. In the Tables, the relative intensities are given in terms of the symbols vs=very strong, s=strong, m=medium, w=weak, etc.

TABLE II

| 2θ | d(Å) | 100 × $I/I_0$ |
|---|---|---|
| 8.05–8.3 | 10.98–10.65 | 20–42 |
| 9.4–9.65 | 9.41–9.17 | 36–58 |
| 13.1–13.4 | 6.76–6.61 | 12–16 |
| 15.6–15.85 | 5.68–5.59 | 23–38 |
| 16.2–16.4 | 5.47–5.40 | 3–5 |
| 18.95–19.2 | 4.68–4.62 | 5–6 |
| 20.3–20.6 | 4.37–4.31 | 36–49 |
| 21.0–21.3 | 4.23–4.17 | 100 |
| 22.1–22.35 | 4.02–3.99 | 47–59 |
| 22.5–22.9 (doublet) | 3.95–3.92 | 55–60 |
| 23.15–23.35 | 3.84–3.81 | 64–74 |
| 24.5–24.9 (doublet) | 3.63–3.58 | 7–10 |
| 26.4–26.8 (doublet) | 3.38–3.33 | 11–19 |
| 27.2–27.3 | 3.28–3.27 | 0–1 |
| 28.3–28.5 (shoulder) | 3.15–3.13 | 11–17 |
| 28.6–28.85 | 3.121–3.094 | |
| 29.0–29.2 | 3.079–3.058 | 0–3 |
| 29.45–29.65 | 3.033–3.013 | 5–7 |
| 31.45–31.7 | 2.846–2.823 | 7–9 |
| 32.8–33.1 | 2.730–2.706 | 11–14 |
| 34.1–34.4 | 2.629–2.607 | 7–9 |
| 35.7–36.0 | 2.515–2.495 | 0–3 |
| 36.3–36.7 | 2.475–2.449 | 3–4 |
| 37.5–38.0 (doublet) | 2.398–2.368 | 10–13 |
| 39.3–39.55 | 2.292–2.279 | 2–3 |
| 40.3 | 2.238 | 0–2 |
| 42.2–42.4 | 2.141–2.132 | 0–2 |
| 42.8–43.1 | 2.113–2.099 | 3–6 |
| 44.8–45.2 (doublet) | 2.023–2.006 | 3–5 |
| 45.9–46.1 | 1.977–1.969 | 0–2 |

TABLE II-continued

| 2θ | d(Å) | 100 × $I/I_0$ |
|---|---|---|
| 46.8–47.1 | 1.941–1.929 | 0–1 |
| 48.7–49.0 | 1.870–1.859 | 2–3 |
| 50.5–50.8 | 1.807–1.797 | 3–4 |
| 54.6–54.8 | 1.681–1.675 | 2–3 |
| 55.4–55.7 | 1.658–1.650 | 0–2 |

Another intermediate pore size silicoaluminophosphate molecular sieve preferably used in the process of the invention is SAPO-31. SAPO-31 comprises a silicoaluminophosphate having a three-dimensional microporous crystal framework of [$PO_2$], [$AlO_2$] and [$SiO_2$]tetrahedral units whose unit empirical formula on an anhydrous basis is: mR: (Si x Al y P z)$O_2$ wherein R represents at least one organic templating agent present in the intracrystalline pore system; "m" represents the moles of "R" present per mole of (Si x Al y P z)$O_2$ and has a value of from zero to 0.3; "x", "y" and "z" represent, respectively, the mole fractions of silicon, aluminum and phosphorous. The silicoaluminophosphate has a characteristic X-ray powder diffraction pattern (as-synthesized and calcined) which contains at least the d-spacings set forth below in Table III. When SAPO-31 is in the as-synthesized form, "m" preferably has a value of from 0.02 to 0.3.

TABLE III

| 2θ | d(Å) | Relative Intensity |
|---|---|---|
| 8.5–8.6 | 10.40–10.28 | m–s |
| 20.2–20.3 | 4.40–4.37 | m |
| 21.9–22.1 | 4.06–4.02 | w–m |
| 22.6–22.7 | 3.93–3.92 | vs |
| 31.7–31.8 | 3.823–2.814 | w–m |

All of the as-synthesized SAPO-31 compositions for which X-ray powder diffraction data have presently been obtained have patterns which are within the generalized pattern of Table IV below.

TABLE IV

| 2θ | d(Å) | 100 × $I/I_0$ |
|---|---|---|
| 6.1 | 14.5 | 0–1 |
| 8.5–8.6* | 10.40–10.28 | 60–72 |
| 9.5* | 9.31 | 7–14 |
| 13.2–13.3* | 6.71–6.66 | 1–4 |
| 14.7–14.8 | 6.03–5.99 | 1–2 |
| 15.7–15.8* | 5.64–5.61 | 1–8 |
| 17.05–17.1 | 5.20–5.19 | 2–4 |
| 18.3–18.4 | 4.85–4.82 | 2–3 |
| 20.2–20.3 | 4.40–4.37 | 44–55 |
| 21.1–21.2* | 4.21–4.19 | 6–28 |
| 21.9–22.1* | 4.06–4.02 | 32–38 |
| 22.6–22.7* | 3.93–3.92 | 100 |
| 23.3–23.35 | 3.818–3.810 | 2–20 |
| 25.1* | 3.548 | 3–4 |
| 25.65–25.75 | 3.473–3.460 | 2–3 |
| 26.5* | 3.363 | 1–4 |
| 27.9–28.0 | 3.198–3.187 | 8–10 |
| 28.7* | 3.110 | 0–2 |
| 29.7* | 3.008 | 4–5 |
| 31.7–31.8 | 2.823–2.814 | 15–18 |
| 32.9–33.0* | 2.722–2.714 | 0–3 |
| 35.1–35.2 | 2.557–2.550 | 5–8 |
| 36.0–36.1 | 2.495–2.488 | 1–2 |
| 37.2 | 2.417 | 1–2 |
| 37.9–38.1* | 2.374–2.362 | 2–4 |

TABLE IV-continued

| 2θ | d(Å) | 100 × I/I$_0$ |
|---|---|---|
| 39.3 | 2.292 | 2–3 |
| 43.0–43.1* | 2.103–2.100 | 1 |
| 44.8–45.2* | 2.023–2.006 | 1 |
| 46.6 | 1.949 | 1–2 |
| 47.4–47.5 | 1.918 | 1 |
| 48.6–48.7 | 1.872–1.870 | 2 |
| 50.7–50.8 | 1.801–1.797 | 1 |
| 51.6–51.7 | 1.771–1.768 | 2–3 |
| 55.4–55.5 | 1.658–1.656 | 1 |

*Possibly contains peak from a minor impurity.

SAPO41, also suitable for use in the process of the invention, comprises a silicoaluminophosphate having a three-dimensional microporous crystal framework structure of [$PO_2$], [$AlO_2$] and [$SiO_2$]tetrahedral units, and whose unit empirical formula on an anhydrous basis is: mR: (Si x Al y P z)$O_2$ wherein "R" represents at least one organic templating agent present in the intracrystalline pore system; "m" represents the moles of "R" present per mole of (Si x Al y P z)$O_2$ and has a value of from zero to 0.3; "x", "y" and "z" represent, respectively, the mole fractions of silicon, aluminum and phosphorous. The silicoaluminophosphate having a characteristic X-ray powder diffraction pattern (as-synthesized and calcined) which contains at least the d-spacings set forth below in Table V. When SAPO-41 is in the as-synthesized form, "m" preferably has a value of from 0.02 to 0.03.

TABLE V

| 2θ | d(Å) | Relative Intensity |
|---|---|---|
| 13.6–13.8 | 6.51–6.42 | w–m |
| 20.5–20.6 | 4.33–4.31 | w–m |
| 21.1–21.3 | 4.21–4.17 | vs |
| 22.1–22.3 | 4.02–3.99 | m–s |
| 22.8–23.0 | 3.90–3.86 | m |
| 23.1–23.4 | 3.82–3.80 | w–m |
| 25.5–25.9 | 3.493–3.44 | w–m |

All of the as-synthesized SAPO41 compositions for which X-ray powder diffraction data have presently been obtained have patterns which are within the generalized pattern of Table VI below.

TABLE VI

| 2θ | d(Å) | 100 × I/I$_0$ |
|---|---|---|
| 6.7–6.8 | 13.19–12.99 | 15–24 |
| 9.6–9.7 | 9.21–9.11 | 12–25 |
| 13.6–13.8 | 6.51–6.42 | 10–28 |
| 18.2–18.3 | 4.87–4.85 | 8–10 |
| 20.5–20.6 | 4.33–4.31 | 10–32 |
| 21.1–21.3 | 4.21–4.17 | 100 |
| 22.1–22.3 | 4.02–3.99 | 45–82 |
| 22.8–23.0 | 3.90–3.87 | 43–58 |
| 23.1–23.4 | 3.82–3.80 | 20–30 |
| 25.2–25.5 | 3.53–3.49 | 8–20 |
| 25.5–25.9 | 3.493–3.44 | 12–28 |
| 29.3–29.5 | 3.048–3.028 | 17–23 |
| 31.4–31.6 | 2.849–2.831 | 5–10 |
| 33.1–33.3 | 2.706–2.690 | 5–7 |
| 37.6–37.9 | 2.392–2.374 | 10–15 |
| 38.1–38.3 | 2.362–2.350 | 7–10 |
| 39.6–39.8 | 2.276–2.265 | 2–5 |
| 42.8–43.0 | 2.113–2.103 | 5–8 |

TABLE VI-continued

| 2θ | d(Å) | 100 × I/I$_0$ |
|---|---|---|
| 49.0–49.3 | 1.856–1.848 | 1–8 |
| 51.5 | 1.774 | 0–8 |

The process of the invention may also be carried out using a catalyst comprising an intermediate pore size non-zeolitic molecular sieve containing $AlO_2$ and $PO_2$ tetrahedral oxide units, and at least one Group VIII metal. Exemplary suitable intermediate pore size non-zeolitic molecular sieves are set forth in European patent Application No. 158,977 which is incorporated herein by reference.

The group of intermediate pore size zeolites of the present invention include ZSM-22, ZSM-23, SSZ-32 (as taught in U.S. Pat. No. 5,252,527, which reference is incorporated herein by reference in its entirety), and ZSM-35. These catalysts are generally considered to be intermediate pore size catalysts based on the measure of their internal structure as represented by their Constraint Index. Zeolites which provide highly restricted access to and egress from their internal structure have a high value for the Constraint Index, while zeolites which provide relatively free access to the internal zeolite structure have a low value for their Constraint Index. The method for determining Constraint Index is described fully in U.S. Pat. No. 4,016,218 which is incorporated herein by reference.

Those zeolites exhibiting a Constraint Index value within the range of from about 1 to about 12 are considered to be intermediate pore size zeolites. Zeolites which are considered to be in this range include ZSM-5, ZSM-11, etc. Upon careful examination of the intermediate pore size zeolites, however, it has been found that not all of them are efficient as a catalyst for isomerization of a paraffin-containing feedstock which are high in $C_{20}$+ paraffins, and preferably which are high in $C_{22}$+ paraffins. In particular, it has been found that the group including ZSM-22, ZSM-23 and ZSM-35 used in combination with Group VIII metals can provide a means whereby a hydrocarbon feedstock having a paraffinic content with molecules of 20 carbon atoms or more undergoes unexpectedly efficient isomerization without destroying the ultimate yield of the feedstock.

It is known to use prior art techniques for formation of a great variety of synthetic aluminosilicates. These aluminosilicates have come to be designated by letter or other convenient symbols. One of the zeolites of the present invention, ZSM-22, is a highly siliceous material which includes crystalline three-dimensional continuous framework silicon containing structures or crystals which result when all the oxygen atoms in the tetrahedra are mutually shared between tetrahedral atoms of silicon or aluminum, and which can exist with a network of mostly $SiO_2$, i.e., exclusive of any intracrystalline cations. The description of ZSM-22 is set forth in full in U.S. Pat. No. 4,556,477, U.S. Pat. No. 4,481,177, and European Patent Application No.102,716, the contents of which are incorporated herein by reference.

As indicated in U.S. Pat. No. 4,566,477, the crystalline material ZSM-22 has been designated with a characteristic X-ray diffraction pattern as set forth in Table VII.

TABLE VII

| Most Significant Lines of ZSM-22 | |
|---|---|
| Interplanar d-spacings (Å) | Relative Intensity ($I/I_0$) |
| 10.9 +/− 0.2 | M–VS |
| 8.7 +/− 0.16 | W |
| 6.94 +/− 0.10 | W–M |
| 5.40 +/− 0.08 | W |
| 4.58 +/− 0.07 | W |
| 4.36 +/− 0.07 | VS |
| 3.68 +/− 0.05 | VS |
| 3.62 +/− 0.05 | S–VS |
| 3.47 +/− 0.04 | M–S |
| 3.30 +/− 0.04 | W |
| 2.74 +/− 0.02 | W |
| 2.52 +/− 0.02 | W |

It should be understood that the X-ray diffraction pattern of Table VII is characteristic of all the species of ZSM-22 zeolite compositions. Ion exchange of the alkali metal cations with other ions results in a zeolite which reveals substantially the same X-ray diffraction pattern with some minor shifts in interplanar spacing and variation in relative intensity.

Furthermore, the original cations of the as-synthesized ZSM-22 can be replaced at least in part by other ions using conventional ion exchange techniques. It may be necessary to pre-calcine the ZSM-22 zeolite crystals prior to ion exchange. In accordance with the present invention, the replacement ions are those taken from Group VIII of the Periodic Table, especially platinum, palladium, iridium, osmium, rhodium and ruthenium.

ZSM-22 freely sorbs normal hexane and has a pore dimension greater than about 4 Angstroms. In addition, the structure of the zeolite provides constrained access to larger molecules. The Constraint Index as determined by the procedure set forth in U.S. Pat. No. 4,016,246 for ZSM-22 has been determined to be from about 2.5 to about 3.0.

Another zeolite which can be used with the present invention is the synthetic crystalline aluminosilicate referred to as ZSM-23, disclosed in U.S. Pat. No.4,076,842, the contents of which are incorporated herein by reference. The ZSM-23 composition has a characteristic X-ray diffraction pattern as set forth herein in Table VIII.

Other molecular sieves which can be used with the present invention include, for example, Theta-1, as described in U.S. Pat. Nos. 4,533,649 and 4,836,910, both of which are incorporated in their entireties by reference, Nu-10, as described in European Patent Application 065,400 which is incorporated in its entirety by reference and SSZ-20 as described in U.S. Pat. No. 4,483,835 which is incorporated in its entirety by reference.

TABLE VIII

| d(Å) | $I/I_0$ |
|---|---|
| 11.2 +/− 0.23 | M |
| 10.1 +/− 0.20 | W |
| 7.87 +/− 0.15 | W |
| 5.59 +/− 0.10 | W |
| 5.44 +/− 0.10 | W |
| 4.90 +/− 0.10 | W |
| 4.53 +/− 0.10 | S |
| 3.90 +/− 0.08 | VS |
| 3.72 +/− 0.08 | VS |
| 3.62 +/− 0.07 | VS |
| 3.54 +/− 0.07 | M |
| 3.44 +/− 0.07 | S |

TABLE VIII-continued

| d(Å) | $I/I_0$ |
|---|---|
| 3.36 +/− 0.07 | W |
| 3.16 +/− 0.07 | W |
| 3.05 +/− 0.06 | W |
| 2.99 +/− 0.06 | W |
| 2.85 +/− 0.06 | W |
| 2.54 +/− 0.05 | M |
| 2.47 +/− 0.05 | W |
| 2.40 +/− 0.05 | W |
| 2.34 +/− 0.05 | W |

The ZSM-23 composition can also be defined in terms of mole ratios of oxides in the anhydrous state as follows:

$$(0.58–3.4)M_{2/n}O: Al_2O_3: (40–250)SiO_2$$

wherein M is at least 1 cation and n is the valence thereof. As in the ZSM-22, the original cations of as-synthesized ZSM-23 can be replaced in accordance with techniques well known in the art, at least in part by ionic exchange with other cations. In the present invention, these cations include the Group VIII metals as set forth hereinbefore.

The third intermediate pore size zeolite which has been found to be successful in the present invention is ZSM-35, which is disclosed in U.S. Pat. No. 4,016,245, the contents of which are incorporated herein by reference. The synthetic crystalline aluminosilicate known as ZSM-35 has a characteristic X-ray diffraction pattern which is set forth in U.S. Pat. No. 4,016,245. ZSM-35 has a composition which can be defined in terms of mole ratio of oxides in the anhydrous state as follows:

$$(0.3–2.5)R_2O: (0–0.8)M_2O:Al_2O3:>8SiO_2$$

wherein R is organic nitrogen-containing cation derived from ethylenediamine or pyrrolidine and M is an alkali metal cation. The original cations of the as-synthesized ZSM-35 can be removed using techniques well known in the art which includes ion exchange with other cations. In the present invention, the cation exchange is used to replace the as-synthesized cations with the Group VIII metals set forth herein. It has been observed that the X-ray diffraction pattern of ZSM-35 is similar to that of natural ferrierite with a notable exception being that natural ferrierite patterns exhibit a significant line at 1.33 Angstroms.

X-ray crystallography of SAPO-11, SAPO-31, SAPO-41, ZSM-22, ZSM-23 and ZSM-35 shows these molecular sieves to have the following major and minor axes: SAPO-11, major 6.3 Angstroms, minor 3.9 Angstroms; (Meier, W. M., Olson, D. H., and Baerlocher, Ch., Atlas of Zeolite Structure Types, Elsevier, 1996), SAPO-31 and SAPO-41, believed to be slightly larger than SAPO-11, ZSM-22, major 5.5 Angstroms, minor 4.5 Angstroms (Kokotailo, G. T., et al, Zeolites, 5, 349(85)); ZSM-23, major 5.6 Angstroms, minor 4.5 Angstroms; ZSM-35, major 5.4 Angstroms, minor 4.2 Angstroms (Meier, W. M. and Olsen, D. H., Atlas of Zeolite Structure Types, Butterworths, 1987).

The intermediate pore size molecular sieve is used in admixture with at least one Group VIII metal. Preferably, the Group VIII metal is selected from the group consisting of at least one of platinum and palladium and, optionally, other catalytically active metals such as molybdenum, nickel, vanadium, cobalt, tungsten, zinc and mixtures thereof. Most preferably, the Group VIII metal is selected from the group consisting of at least one of platinum and palladium. The amount of metal ranges from about 0.01% to about 10% by weight of the molecular sieve, preferably from about 0.2% to about 5% by weight of the molecular sieve. The techniques of introducing catalytically active metals into a molecular sieve are disclosed in the literature, and preexisting metal incorporation techniques and treatment of the molecular sieve to form an active catalyst such as ion exchange, impregnation or occlusion during sieve preparation are suitable for use in the present process. Such techniques are disclosed in U.S. Pat. Nos. 3,236,761; 3,226,339; 3,236,762; 3,620,960; 3,373,109; 4,202,996; 4,440,781 and 4,710,485 which are incorporated herein by reference.

The term "metal" or "active metal" as used herein means one or more metals in the elemental state or in some form such as sulfide, oxide and mixtures thereof. Regardless of the state in which the metallic component actually exists, the concentrations are computed as if they existed in the elemental state.

The catalyst may also contain metals which reduce the number of strong acid sites on the catalyst and thereby lower the selectivity for cracking versus isomerization. Especially preferred are the Group IIA metals such as magnesium and calcium.

It is preferred that relatively small crystal size catalyst be utilized in practicing the invention. Suitably, the average crystal size is no greater than about 10 mu, preferably no more than about 5 mu, more preferably no more than about 1 mu, and still more preferably no more than about 0.5 mu.

Strong acidity may also be reduced by introducing nitrogen compounds, e.g., $NH_3$ or organic nitrogen compounds, into the feed; however, the total nitrogen content should be less than 50 ppm, preferably less than 10 ppm. The physical form of the catalyst depends on the type of catalytic reactor being employed and may be in the form of a granule or powder, and is desirably compacted into a more readily usable form (e.g., larger agglomerates), usually with a silica or alumina binder for fluidized bed reaction, or pills, prills, spheres, extrudates, or other shapes of controlled size to accord adequate catalyst-reactant contact.

The catalyst may be employed either as a fluidized catalyst, or in a fixed or moving bed, and in one or more reaction stages.

The catalytic isomerization step of the invention may be conducted by contacting the feed with a fixed stationary bed of catalyst, with a fixed fluidized bed, or with a transport bed. A simple and therefore preferred configuration is a trickle-bed operation in which the feed is allowed to trickle through a stationary fixed bed, preferably in the presence of hydrogen.

The catalytic isomerization conditions employed depend on the feed used and the desired pour point. Generally, the temperature is from about 200° C. to about 475° C., preferably from about 250° C. to about 450° C. The pressure is typically from about 15 psig and to about 2000 psig, preferably from about 50 to about 1000 psig, more preferably from about 100 psig to about 600 psig. The process of the invention is preferably carried out at low pressure. The liquid hourly space velocity (LHSV) is preferably from about 0.1 to about 20, more preferably from about 0.1 to about 5, and most preferably from about 0.1 to about 1.0. Low pressure and low liquid hourly space velocity provide enhanced isomerization selectivity which results in more isomerization and less cracking of the feed thus producing an increased yield.

Hydrogen is preferably present in the reaction zone during the catalytic isomerization process. The hydrogen to feed ratio is typically from about 500 to about 30,000 SCF/bbl (standard cubic feet per barrel), preferably from about 1,000 to about 10,000 SCF/bbl. Generally, hydrogen will be separated from the product and recycled to the reaction zone.

The intermediate pore size molecular sieve used in the isomerization step provides selective conversion of the waxy components to non-waxy components. During processing, isomerization of the paraffins occurs to reduce the pour point of the oil below that of the feed and form lube oil boiling range materials which contribute to a low pour point product having excellent viscosity index properties. Because of the selectivity of the intermediate pore size molecular sieve used in the invention, the yield of low boiling products is reduced, thereby preserving the economic value of the feedstock.

The intermediate pore size molecular sieve catalyst can be manufactured into a wide variety of physical forms. The molecular sieves can be in the form of a powder, a granule, or a molded product, such as an extrudate having a particle size sufficient to pass through a 2-mesh (Tyler) screen and be retained on a 40-mesh (Tyler) screen. In cases wherein the catalyst is molded, such as by extrusion with a binder, the silicoaluminophosphate can be extruded before drying, or dried or partially dried, and then extruded.

The molecular sieve can be composited with other materials resistant to temperatures and other conditions employed in the isomerization process. Such matrix materials include active and inactive materials and synthetic or naturally occurring zeolites as well as inorganic materials such as clays, silica and metal oxides. The latter may be either naturally occurring or in the form of gelatinous precipitates, sols or gels including mixtures of silica and metal oxides. Inactive materials suitably serve as diluents to control the amount of conversion in the isomerization process so that products can be obtained economically without employing other means for controlling the rate of reaction. The molecular sieve may be incorporated into naturally occurring clays, e.g., bentonite and kaolin. These materials, i.e., clays, oxides, etc., function, in part, as binders for the catalyst. It is desirable to provide a catalyst having good crush strength because in petroleum refining, the catalyst is often subjected to rough handling. This tends to break the catalyst down into powderlike materials which cause problems in processing.

Naturally occurring clays which can be composited with the molecular sieve include the montmorillonite and kaolin families, which families include the sub-bentonites, and the kaolins commonly known as Dixie, McNamee, Georgia and Florida clays or others in which the main mineral constituent is halloysite, kaolinite, diokite, nacrite or anauxite. Fibrous clays such as halloysite, sepiolite and attapulgite can also be use as supports. Such clays can be used in the raw state as originally mined or initially subjected to calcination, acid treatment or chemical modification.

In addition to the foregoing materials, the molecular sieve can be composited with porous matrix materials and mixtures of matrix materials such as silica, alumina, titania, magnesia, silica-alumina, silica-magnesia, silica-zirconia, silica-thoria, silica-beryllia, silica-titania, titania-zirconia as well as ternary compositions such as silica-alumina-thoria, silica-aluminatitania, silica-alumina-magnesia and silica-magnesia-zirconia. The matrix can be in the form of a cogel.

The catalyst used in the process of this invention can also be composited with other zeolites such as synthetic and natural faujasites, (e.g., X and Y) erionites, and mordenites. It can also be composited with purely synthetic zeolites such as those of the ZSM series. The combination of zeolites can also be composited in a porous inorganic matrix.

It is often desirable to use mild hydrogenation referred to as hydrofinishing after isomerization to produce more stable lubricating oils. Hydrofinishing is typically conducted at temperatures ranging from about 190° C. to about 340° C., at pressures from about 400 psig to about 3000 psig, at space velocities (LHSV) from about 0.1 to about 20, and hydrogen recycle rates of from about 400 to about 1500 SCF/bbl. The hydrogenation catalyst employed must be active enough not only to hydrogenate the olefins, diolefins and color bodies within the lube oil fractions, but also to reduce the aromatic content (color bodies). The hydrofinishing step is beneficial in preparing an acceptably stable lubricating oil. Suitable hydrogenation catalysts include conventional metallic hydrogenation catalysts, particularly the Group VIII metals such as cobalt, nickel, palladium and platinum. The metals are typically associated with carriers such as bauxite, alumina, silica gel, silica-alumina composites, and crystalline aluminosilicate zeolites. Palladium is a particularly preferred hydrogenation metal. If desired, non-noble Group VIII metals can be used with molybdates. Metal oxides or sulfides can be used. Suitable catalysts are disclosed in U.S. Pat. Nos. 3,852,207; 4,157,294; 3,904,513 and 4,673,487, which are incorporated herein by reference.

The high viscosity index lube oil produced by the process of the present invention can be used as a blending component to raise the viscosity index of lube oils to a higher value. Since yield decreases with increasing viscosity index in either hydrocracking or solvent refining, the use of an isomerized wax to increase the viscosity index improves yield.

F. High Viscosity Index Lubricating Oil Composition

The process of the invention includes a process for making a high viscosity index lubricating oil composition. The terms "high viscosity index" lubricating oil composition and "unconventional base oil" do not have strict definitions. In general, they refer to base oils having desirable viscometric properties not typically found in mineral oils and generally only available in expensive synthetic base oils. The marketplace recognizes the desirability of viscometric properties of high-viscosity index and unconventional base oils in that they command a higher price than "conventional" oils. Thus, the relative price is also an indicator of unconventional and high viscosity index base oils.

To avoid ambiguity, the term "high viscosity index" mineral oil or lubricating oil composition as used in this specification and appended claims means (1) a viscosity index of at least 90 for a mineral oil having a viscosity of 3.0 centistokes at 100° C.; (2) a viscosity index of at least 105 for a lubricating oil composition having a viscosity of 4 centistokes at 100° C.; (3) a viscosity index of at least 115 for a lubricating oil composition having a viscosity of 5.0 centistokes at 100° C.; and (4) a viscosity index of at least 120 for a lubricating oil composition having a viscosity of 7.0 centistokes at 100° C. "High" viscosity indices for other viscosities between 3.0 and 7.0 can be determined by conventional interpolation.

The viscosity indices of the high VI base oils made in the present invention are much higher than those commonly used in conventional oils in the industry. Known methods of manufacturing high VI base oils, using a mineral oil feed, use a combination of hydrocracking followed by catalytic isomerization dewaxing. Two such processes are licensed under the names of ISOCRACKING and ISODEWAXING.

ILLUSTRATIVE EMBODIMENTS

The invention will be further clarified by the following Illustrative Embodiments, which are intended to be purely exemplary of the invention. The results are shown in Tables IX–XVI below.

Example 1

High density polyethylene (HDPE) was pyrolyzed in a pyrolysis reactor at atmospheric pressure and different temperatures, as shown in Table IX, which also gives yields of gas, residue, and waxy oil, as well as boiling point distributions of the waxy oil. This table shows that most of the oil in the lube boiling range was in the range of 650–1000° F., with little boiling in the bright stock range above 1000° F.

The waxy oil fraction of the material pyrolyzed at 650° C. was evaluated by high pressure liquid chromatography followed by GC-MS. It was found to be composed almost entirely of n-paraffins and 1-olefins, as shown in Table X.

Example 2

Figure 2:
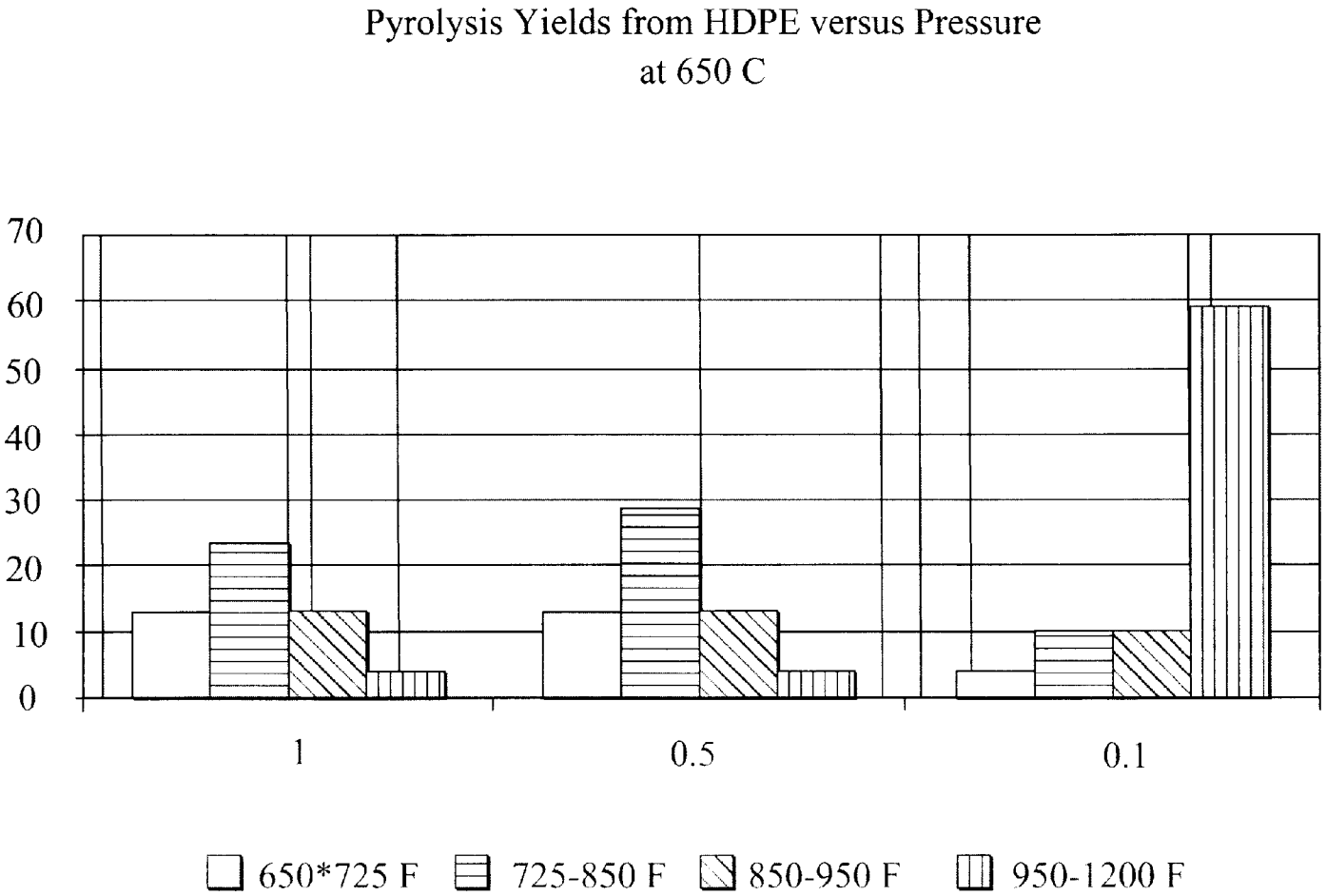
FIG. 2 is a bar graph depicting the effect of pressure in the pyrolysis zone from experimental results discussed in the "Illustrative Embodiments" section of this specification.

HDPE was pyrolyzed in the pyrolysis reactor, as in Example 1, except at sub-atmospheric pressure, as indicated in Table XI and FIG. 2. This shows not only an increase in the yield of lube range waxy oil (650° F.+), but also a large increase in bright stock range waxy oil (950–1200° F.).

Example 3

Waste HDPE, obtained from a recycling center, was pyrolyzed at 650° C. and 0.5 atm pressure. Table XII shows the results are very similar to those obtained with the virgin HDPE of Examples 1 and 2.

Example 4

Figure 3:
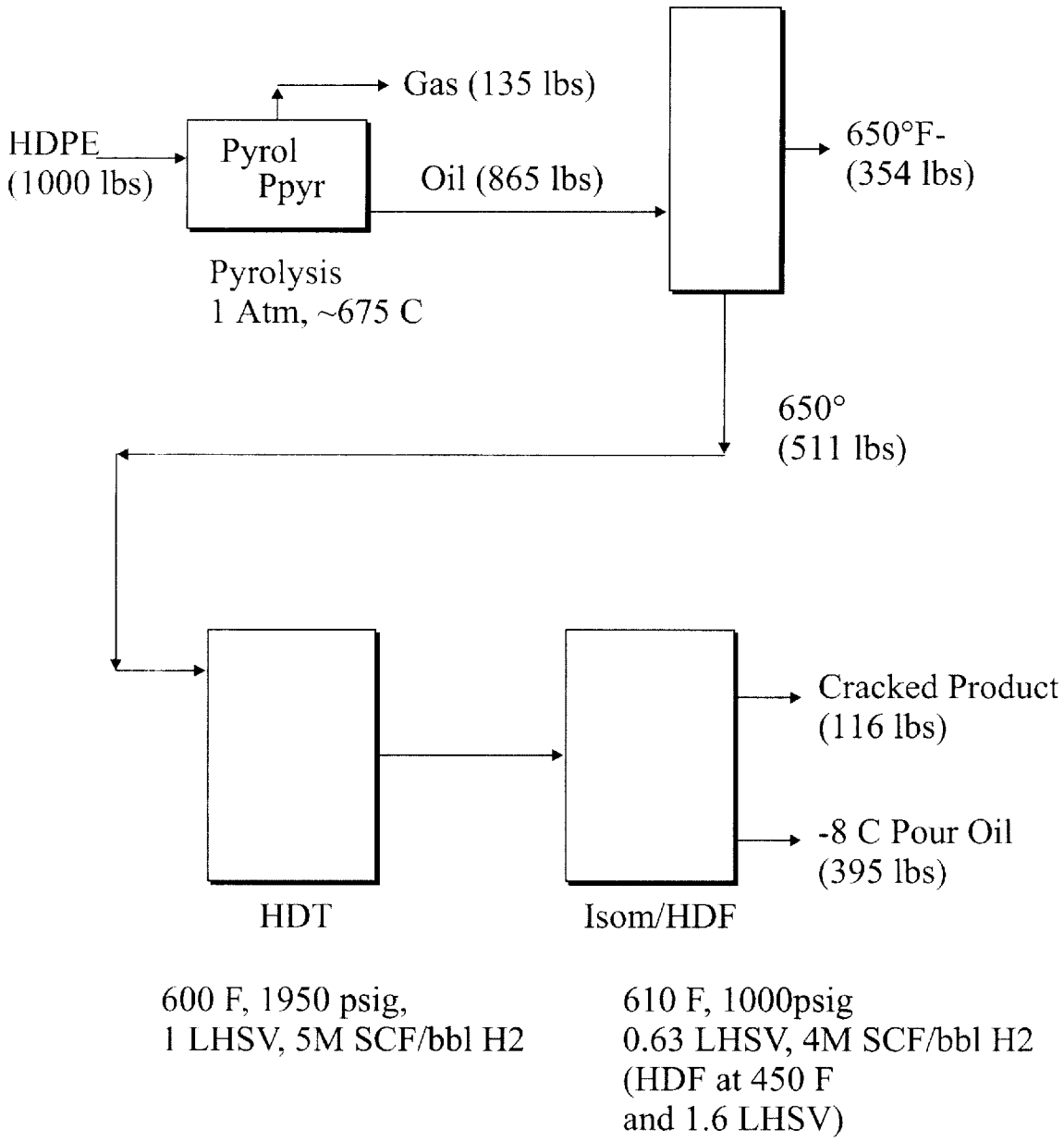
FIG. 3 is a schematic flow drawing of a portion of one embodiment of the process of the invention and depicts experimental results discussed in the "Illustrative Embodiments" section of this specification.

The waxy oil produced in Example 1 at atmospheric pressure and 650, 675, and 700° C. was composited. The waxy oil yield of the composite was 86.5 wt %. This oil was distilled at 650° F. to give 59.1 wt % 650° F.+ bottoms (51.1 wt % based on HDPE feed). The 650° F.+ bottoms were then hydrotreated over a Ni—Mo hydrotreating catalyst at 600° F., 1950 psig, 1 LHSV, and 5 MSCF/bbl once-through H2 to reduce the nitrogen level to below 1 ppm. Conversion of 650° F.+ material in the feed to 650° F. – was less than 1%. The hydrotreated oil was then processed at 1000 psig and 4 MSCF/bbl once-through H2 over an isomerization dewaxing catalyst at 610° F. and 0.63 LHSV followed by a hydrofinishing catalyst at 450° F. and 1.6 LHSV. The isomerization catalyst was Pt on SAPO-11 (made according to U.S. Pat. No. 5,135,638) and the hydrofinishing catalyst was Pt/Pd on SiO2–Al2O3. This gave a 4 cSt oil (viscosity measured at 100° C.) with a pour point of–8° C. and a viscosity index of 153, as shown in Table XIII. The 650° F.+ yield through the isomerization step was 67 wt %. A flow diagram of the process, based on 1000 pounds of HDPE, is given in FIG. 3.

Example 5

HDPE was pyrolyzed in the pyrolysis reactor at sub-atmospheric pressure, as shown in Table XIV to again give a large amount of both lube and bright stock range waxy oil.

Example 6

The waxy oil produced in Example 2 at 0.10 atm pressure and 600, 650, and 700° C. was composited (distillation analysis shown in Table XV) and hydrotreated over a Ni—Mo hydrotreating catalyst at 600° F., 1950 psig, 1 LHSV, and 5 MSCF/bbl once-through H2 to reduce the nitrogen level to below 1 ppm. Conversion of 650° F.+ material in the feed to 650° F.– was less than 1%. The waxy oil was then isomerized as in Example 4, but at an isomerization temperature of 685° F., to give a 9 cSt oil with a pour point of 0° C. and a 137 VI, as shown in Table XVI.

Example 7

The waxy oil produced in Example 2 at 0.5 atm pressure and 550, 600 and 650° C. was composited (distillation analysis shown in Table XV) and hydrotreated over a Ni—Mo hydrotreating catalyst at 600° F., 1950 psig, 1 LHSV, and 5 MSCF/bbl once-through H2 to reduce the nitrogen level to below 1 ppm. Conversion of 650° F.+ material in the feed to 650° F.− was less than 1%. The waxy oil was then isomerized as in Example 4, but at an isomerization temperature of 648° F., to give a 3.7 cSt oil with a pour point of −22° C. and a 153 VI, as shown in Table XVI.

TABLE XII

COMPARISON OF WASTE HDPE VERSUS PLANT HDPE FOR PYROLYSIS AT 650° C. AND 0.5 ATM

| Feed | HDPE | Waste HDPE |
|---|---|---|
| Oil Yield, Wt % | 90.1 | 86.7 |
| Residue, Wt % | 0 | 0.9 |
| Gas Yield, Wt % | 6.3 | 11.7 |
| Oil Inspections | | |
| ST/5 | 182/385 | 186/368 |
| 10/30 | 457/626 | 442/619 |

TABLE IX

HPDE PYROLYSIS RESULTS AT 1 ATM

| | 550 | 575 | 600 | 625 | 650 | 675 | 700 |
|---|---|---|---|---|---|---|---|
| Pyrolysis Temp, ° F. | | | | | | | |
| Oil Yield, Wt % | 85.2 | 88.8 | 88.8 | 87.4 | 87.0 | 86.0 | 86.5 |
| 650° F. + Yield, Wt % | 35.8 | 39.1 | 41.6 | 47.1 | 53.5 | 52.1 | 53.6 |
| 700° F. + Yield, Wt % | 29.2 | 32.3 | 34.7 | 41.0 | 44.8 | 44.9 | 46.4 |
| Oil Inspections | | | | | | | |
| Sim. Dist., LV %, ° F. | | | | | | | |
| ST/5 | 80/201 | 75/253 | 80/201 | 87/208 | 186/338 | 188/328 | 188/328 |
| 10/30 | 253/443 | 253/449 | 256/458 | 280/487 | 403/588 | 390/588 | 394/596 |
| 50 | 580 | 598 | 620 | 660 | 711 | 715 | 722 |
| 70/90 | 714/872 | 729/877 | 743/898 | 796/952 | 803/892 | 808/902 | 818/908 |
| 95/EP | 934/1027 | 938/1021 | 954/1032 | 1003/1089 | 928/1224 | 931/1224 | 940/1224 |

TABLE X

ANALYSIS OF WAXY OIL PYROLYZED AT 1 ATM AND 650° C.

| | Wt % |
|---|---|
| N-Paraffins | ~50 |
| 1-Olefins | ~49 |
| Aromatics | 0.7 |
| Polars | 0.4 |

TABLE XI

HDPE PYROLYSIS RESULTS AT REDUCED PRESSURE

| Pyrolysis Pressure, Atm | 0.5 | 0.5 | 0.5 | 0.1 | 0.1 | 0.1 |
|---|---|---|---|---|---|---|
| Pyrolysis Temp, ° C. | 600 | 650 | 700 | 550 | 600 | 650 |
| Oil Yield, Wt % | 88.8 | 90.1 | 89.7 | 83.5 | 88.0 | 89.1 |
| Residue, Wt % | 1.8 | 0 | 0 | 3.0 | 0 | 0 |
| Gas Yield, Wt % | 5.9 | 6.3 | 6.7 | 6.5 | 7.3 | 10.6 |
| 650° F. + Yield, Wt % | 45.6 | 58.8 | 63.9 | 50.9 | 74.4 | 82.7 |
| 700° F. + Yield, Wt % | 38.7 | 50.2 | 56.2 | 41.4 | 70.0 | 80.4 |
| Oil Inspections | | | | | | |
| Sim. Dist., Wt %, ° F. | | | | | | |
| ST/5 | 308/317 | 182/385 | 181/402 | 183/366 | 194/478 | 184/605 |
| 10/30 | 342/521 | 457/626 | 486/658 | 442/604 | 573/792 | 704/925 |
| 50 | 658 | 730 | 760 | 702 | 948 | 1052 |
| 70/90 | 777/928 | 807/889 | 837/910 | 777/864 | 1068/1098 | 1085/1103 |
| 95/99 | 992/1181 | 922/1224 | 941/1071 | 897/997 | 1106/1224 | 1107/1149 |

TABLE XII-continued

COMPARISON OF WASTE HDPE VERSUS PLANT HDPE FOR PYROLYSIS AT 650° C. AND 0.5 ATM

| Feed | HDPE | Waste HDPE |
|---|---|---|
| 50 | 730 | 723 |
| 70/90 | 807/889 | 810/900 |
| 95/99 | 922/1224 | 939/1224 |

TABLE XIII

INSPECTIONS IN CONERVERSION OF HDPE TO LUBE OIL

| Identification | HDPE Feed | Pyrolyzed PE 650–700° C. Comp. | HDT'd 650° F. + Feed | Isomerized Oil |
|---|---|---|---|---|
| Gravity, API | | | 40.0 | 40.0 |
| Nitrogen, ppm | 53 | 29 | 0.2 | |
| Oxygen, ppm | 147 | 297 | | |
| Pour Pt, ° C. | | | | −8 |
| Cloud Pt, ° C. | | | | +12 |
| Viscosity, 40° C., cSt | | | | 17.07 |
| 100 C., cSt | | | | 4.155 |
| VI | | | | 153 |
| Sim. Dist., TGA, LV %, ° F. | | | | |
| ST/5 | | 186/341 | 193/701 | 362/559 |
| 10/30 | | 422/625 | 759/850 | 621/711 |
| 50 | | 752 | 906 | 781 |
| 70/90 | | 847/935 | 950/997 | 860/959 |
| 95/EP | | 961/ | 1014/ | 993/1034 |

TABLE XIV

HPDE PYROLYSIS RESULTS AT REDUCED PRESSURE

| | | | | | | |
|---|---|---|---|---|---|---|
| Pyrolysis Temperature, ° C. | 650 | 650 | 650 | 650 | 700 | 700 |
| Pyrolysis Pressure, Atm | 0.5 | 0.25 | 0.25 | 0.1 | 0.5 | 0.25 |
| +0.5% $Na_2CO_3$ | No | No | Yes | No | No | No |
| Gas, Wt % | 9.63 | 8.92 | 7.23 | 8.04 | 4.9 | 6.3 |
| Naphtha, Wt % | 14.39 | 5.00 | 5.71 | 6.18 | 20.9 | 11.38 |
| Oil, Wt % | 75.98 | 86.08 | 86.70 | 85.78 | 68.04 | 82.32 |
| Residue, Wt % | 0 | 0 | 0.25 | 0 | 0.28 | 0 |
| 650 F+ Yield, Wt % | 68.9 | 78.7 | 79.0 | 82.8 | 64.4 | 82.20 |
| 1000 F+ Yield, Wt % | 26.8 | 43.4 | 44.9 | 57.4 | 5.7 | 71.39 |
| Inspections | | | | | | |
| Naphtha | | | | | | |
| Sim. Dist., LV %, ° F. | | | | | | |
| ST/5 | 64/147 | 82/148 | 139/177 | 75/148 | 81/150 | 92/157 |
| 10/30 | 155/252 | 171/251 | 206/261 | 178/262 | 174/266 | 203/293 |
| 50 | 340 | 336 | 339 | 376 | 375 | 379 |
| 70/90 | 432/605 | 420/621 | 414/546 | 482/650 | 479/628 | 472/627 |
| 95/EP | 693/893 | 727/941 | 651/944 | 730/894 | 713/913 | 710/893 |
| Oil | | | | | | |
| Sim. Dist., Wt %, ° F. | | | | | | |
| ST/5 | 189/554 | 186/569 | 183/573 | 187/674 | 192/597 | 188/831 |
| 10/30 | 640/812 | 670/876 | 665/870 | 784/978 | 671/810 | 949/1077 |
| 50 | 921 | 1003 | 1016 | 1077 | 885 | 1093 |
| 70/90 | 1037/1094 | 1083/1105 | 1085/1106 | 1098/1111 | 941/995 | 1104/1115 |
| 95/EP | 1103/ | 1109/ | 1112/ | 1117/ | 1018/ | 1119/ |
| Chloride, ppm | | <10 | <10 | | | |

TABLE XV

PYROLYZED/HDT'D FEEDS

| Identification Sim. Dist., Wt %, ° F. | 0.5 Atm Composite (600,650,700° C.) | 0.1 Atm Composite (550,600,650° C.) |
|---|---|---|
| ST/5 | 197/523 | 186/542 |
| 10/30 | 585/700 | 605/737 |
| 50 | 778 | 833 |
| 70/90 | 837/903 | 928/1054 |
| 95/ | 932/ | 1078/ |

TABLE XVI

ISOMERIZATION OF HDT'D PYROLYZED HDPE AT 0.62 LHSV, 1950 PSIG, AND 4 MSCF/BBL OVER Pt/SAPO-11

| Feed | 0.5 Atm Composite | 0.1 Atm Composite |
|---|---|---|
| Temperature, ° F. | 648 | 685 |
| Pour Point, ° C. | −22 | 0 |
| Cloud Point, ° C. | +22 | +59 |
| Viscosity, 40° C., cSt | 14.15 | 57.24 |
| 100° C., cSt | 3.672 | 9.034 |
| VI | 153 | 137 |
| Sim. Dist., Wt %, ° F. | | |
| ST/5 | 460/562 | 504/586 |
| 10/30 | 602/693 | 622/720 |
| 50 | 770 | 822 |
| 70/90 | 855/966 | 980/1308 |
| 95/EP | 1004/1088 | 1353/1400 |

What is claimed is:

1. A process for making a high VI lubricating oil composition comprising the steps of:

(a) passing a waste plastics feed comprising polyethylene to a pyrolysis zone, having a sub-atmospheric pressure, whereby at least a portion of said waste plastics feed is cracked, thereby forming a pyrolysis zone effluent comprising 1-olefins and n-paraffins;

(b) passing said pyrolysis zone effluent to a separations zone, thereby separating said pyrolysis zone effluent into at least one heavy fraction and one middle fraction, said middle fraction comprising 1-olefins;

(c) passing at least a portion of said pyrolysis effluent heavy fraction to a catalytic hydrotreating zone wherein at least a portion of said pyrolysis effluent heavy fraction is contacted with a hydrotreating catalyst at hydrotreating conditions, thereby producing a hydrotreated pyrolysis effluent heavy fraction;

(d) passing at least a portion of said hydrotreated pyrolysis effluent heavy fraction to a catalytic isomerization dewaxing zone, wherein at least a portion of said hydrotreated pyrolysis effluent heavy fraction is contacted with an isomerization dewaxing catalyst at isomerization dewaxing conditions, wherein at least a portion of said hydrotreated pyrolysis effluent heavy fraction is converted to a high VI lubricating oil composition; and (e) wherein said high VI lubricating oil composition comprises a lube fraction having a kinematic viscosity at 100° C. of at least about 8 cSt.

2. The process of claim 1, wherein a major portion of said high VI lubricating oil composition boils in the bright stock range.

3. The process of claim 1, wherein said pyrolysis zone is at sub-atmospheric pressure not greater than about 0.75 atmospheres.

4. The process of claim 1, wherein said pyrolysis zone is at sub-atmospheric pressure not greater than about 0.50 atmospheres.

5. The process of claim 1, wherein said lube fraction having a kinematic viscosity at 100° C. of at least about 8 cSt comprises a substantial portion of said high VI lubricating oil composition.

6. The process of claim 1, wherein said lube fraction having a kinematic viscosity at 100° C. of at least about 8 cSt comprises a major portion of said high VI lubricating oil composition.

7. The process of claim 1, wherein pyrolysis zone includes an inert gas selected from the group consisting of nitrogen, hydrogen, steam, methane or a recycled light fraction from said separations zone in step (b).

8. The process of claim 1, wherein said isomerization dewaxing catalyst comprises an intermediate pore size molecular sieve.

9. The process of claim 1, wherein said isomerization dewaxing catalyst comprises an intermediate pore size molecular sieve selected from the group consisting of ZSM-22, ZSM-23, SSZ-32, ZSM-35, SAPO-11, SM-3, and mixtures thereof.

10. The process of claim 1, wherein said isomerization dewaxing catalyst consists essentially of an intermediate pore size molecular sieve selected from the group consisting of SSZ-32, SAPO-11, SM-3, and mixtures thereof.

11. The process of claim 1, wherein said isomerization dewaxing catalyst consists essentially of SSZ-32.

12. The process of claim 1, wherein said waste plastics feed comprises at least about 95 wt. % polyethylene.

13. The process of claim 1, wherein from about 25 wt. % to about 75 wt. % of said pyrolysis zone effluent comprises 1-olefins.

14. The process of claim 1, wherein the yield of said high VI lubricating oil composition based on the weight of said hydrotreated pyrolysis effluent heavy fraction is at least about 50 wt. %.

15. The process of claim 1, wherein the yield of said high VI lubricating oil composition based on the weight of said hydrotreated pyrolysis effluent heavy fraction is at least about 60 wt. %.

16. The process of claim 1, wherein the yield of said high VI lubricating oil composition based on the weight of said hydrotreated pyrolysis effluent heavy fraction is at least about 70 wt. %.

17. The process of claim 1, wherein said pyrolysis zone is a temperature of from about 500° C. to about 700° C.

18. The process of claim 1, wherein said pyrolysis zone is a temperature of from about 600° C. to about 700° C.

19. The process of claim 1, wherein prior to passing said waste plastic feed to said pyrolysis zone, said waste plastic feed is ground and substantially liquefied.

20. The process of claim 1, wherein the S and N levels of said hydrotreated pyrolysis effluent heavy fraction portion are not greater than about 5 ppm S and 1 ppm N.

21. The process of claim 1, wherein said high VI lubricating oil composition has a pour point not greater than about 20° F.

22. The process of claim 1, wherein said high VI lubricating oil composition has a cloud point of not more than about 10° F. higher than its pour point.

23. The process of claim 1, wherein said high VI lubricating oil composition has a pour point not greater than about 15° F.

24. The process of claim 1, wherein said high VI lubricating oil composition has a cloud point not greater than about 25° F.

25. A process for making a high VI lubricating oil composition comprising the steps of:

(a) passing a waste plastics feed comprising polyethylene to a pyrolysis zone having a temperature of from about 600° C. to about 700° C. and pressure not greater than about 0.75 atm., whereby at least a portion of said waste plastics feed is cracked, thereby forming a pyrolysis zone effluent comprising 1-olefins and n-paraffins;

(b) passing said pyrolysis zone effluent, to a separations zone, thereby separating said pyrolysis zone effluent into at least one heavy fraction and one middle fraction, said middle fraction comprising 1-olefins;

(c) passing at least a portion of said pyrolysis effluent heavy fraction to a catalytic hydrotreating zone wherein at least a portion of said pyrolysis effluent heavy fraction is contacted with a hydrotreating catalyst at hydrotreating conditions, thereby producing a hydrotreated pyrolysis effluent heavy fraction;

(d) passing at least a portion of said hydrotreated pyrolysis effluent heavy fraction to a catalytic isomerization dewaxing zone, wherein at least a portion of said hydrotreated pyrolysis effluent heavy fraction is contacted with an isomerization dewaxing catalyst at isomerization dewaxing conditions, wherein at least a portion of said hydrotreated pyrolysis effluent heavy fraction is converted to a high VI lubricating oil composition;

(e) wherein said high VI lubricating oil composition comprises a lube fraction having a kinematic viscosity at 100° C. of at least about 8 cSt; and (f) wherein said high VI lubricating oil composition has a pour point not greater than about 15° F.

26. The process of claim 25, wherein said high VI lubricating oil composition has a cloud point not greater than about 25° F.

27. The process of claim 25, wherein said lube fraction having a kinematic viscosity at 100° C. of at least about 8 cSt comprises at least 10 weight percent of said high VI lubricating oil composition.

28. The process of claim 25, wherein said lube fraction having a kinematic viscosity at 100° C. of at least about 8 cSt comprises at least 50 weight percent of said high VI lubricating oil composition.

* * * * *